US005573135A

United States Patent [19]

Stolzenfeld

[11] Patent Number: 5,573,135

[45] Date of Patent: Nov. 12, 1996

[54] PORTABLE LIQUID TANK WITH MANHOLE COVER, LIQUID MIXER AND UNIVERSAL PRESSURE RELIEF BUNG

[76] Inventor: George P. Stolzenfeld, 9465 Deerpark Ct., Fenton, Mich. 48430

[21] Appl. No.: 221,761

[22] Filed: Apr. 1, 1994

[51] Int. Cl.[6] ..... B65D 51/00

[52] U.S. Cl. ..... 220/601; 220/366.1; 220/367.1

[58] Field of Search ..... 220/601, 366.1, 220/367.1, 203.06

[56] References Cited

U.S. PATENT DOCUMENTS

| | | | |
|---|---|---|---|
| 228,159 | 5/1880 | Wright . | |
| 1,818,249 | 8/1931 | Groble | 220/367.1 |
| 3,964,508 | 6/1976 | Miller | 220/366.1 X |
| 5,016,775 | 5/1991 | Büdenbender . | |
| 5,368,181 | 11/1994 | Myers | 220/367.1 X |

FOREIGN PATENT DOCUMENTS

| | | |
|---|---|---|
| 16806 | 3/1913 | France . |
| 1142713 | 9/1957 | France . |
| 1525969 | 9/1978 | United Kingdom . |

*Primary Examiner*—Steven M. Pollard
*Attorney, Agent, or Firm*—Reising, Ethington, Barnard & Perry

[57] ABSTRACT

A large portable liquid mixing tank has a top wall with a large access opening that is sealingly closed with a manhole cover and also when the manhole cover is removed and a liquid mixer is installed. In either case, the pressure of any air trapped in the tank increases with rising ambient temperature and can be of a magnitude that blows off the manhole cover or mixer when released from the tank. A universal pressure relief bung is adapted to be threaded in a bung flange in the manhole cover, mixer and the tank top wall and is operable with a strategic vent hole arrangement to completely relieve any air pressure in the tank on only one turn of the bung within the shortest of the minimum times required to remove the liquid mixer, the manhole cover and the bung itself.

8 Claims, 3 Drawing Sheets

PORTABLE LIQUID TANK WITH MANHOLE COVER, LIQUID MIXER AND UNIVERSAL PRESSURE RELIEF BUNG

TECHNICAL FIELD

This invention relates to portable liquid mixing tanks and more particularly to the relief of air pressure trapped therein when either a manhole cover or liquid mixer is sealingly mounted thereon.

BACKGROUND OF THE INVENTION

Large portable liquid mixing tanks such as those used to handle automotive paint and solvents have a top with a large access opening that is closed and sealed by a so-called manhole cover for storage and transit. The manhole cover is removed when the paint is to be used and a liquid mixer with mounting cover is sealingly secured in its place to mix the paint or other liquid requiring mixing before use. In either of these closed and sealed conditions, the pressure of any air trapped in the tank when it is empty or partially full and in temporary storage or transit will rise with increasing ambient temperature. The portable automotive paint tanks can be as large as 575 gallon capacity and have a round access opening with a diameter as large as 22 inches and a pressure increase of just a few psi can develop a force on the large area of the manhole cover and liquid mixer mounting cover that can propel or blow it off when released from connection to the tank. The thus propelled object can possibly harm the person effecting its release and/or others in the vicinity in addition to allowing any paint or solvent then in the tank to be spewed out the tank opening. A bung may also be installed in the top of these tanks and it is also prone to being propelled as well if existing air pressure in the tank is not somehow quickly and efficiently relieved before it is freed from the tank.

There are of course a variety of manually operated pressure relief devices for liquid storage tanks, barrels, casks and the like such as those disclosed in U.S. Pat. Nos. 228,159 and 5,016,775, French Patent Numbers 16,806 and 1,142,713, and British Patent Number 1,525,969. However, these prior pressure relief devices are of limited use and not well suited to relieving the pressure in these large portable liquid mixing tanks quickly enough nor do they offer the opportunity of utilizing existing features associated with some if not most of these large portable liquid mixing tanks.

SUMMARY OF THE INVENTION

The present invention provides a significant advancement over these prior devices where a large portable liquid mixing tank, liquid mixer and manhole cover are utilized and in a simple, cost effective, safeguarding manner with a universal pressure relief bung having a strategic venting arrangement that is operable with the manhole cover and liquid mixer and can be used at either or both and also in the top of the tank. The pressure relief bung comprises an integral head and hollow cylindrical section wherein the latter has a closed end at the head and a male thread extending from an open end toward the head. The male thread is adapted to engage a conventional bung flange provided in the top of the tank and also in both the manhole cover and the mixer mounting cover. Thus, the pressure relief bung is of a universal type in that it can be used interchangeably with a conventional or solid bung at one, two or all three of the bung flanges.

A sealing ring received on the hollow cylindrical section of the pressure relief bung has one side adapted to seal against the bung head and an opposite side adapted to seal against the respective bung flanges. The hollow cylindrical section is provided with a plurality of vent holes in a common plane immediately adjacent the bung flange side of the sealing ring and are adapted to communicate the interior of the liquid mixing tank with atmosphere through the open end of the hollow cylindrical section and past the above mentioned opposite side of the sealing ring on initial turning of the pressure relief bung to disengage the seal from the bung flange. The vent holes are provided with a cross-section that is elongated along the above mentioned plane and of a length and width so as to immediately start relieving any gaseous pressure in the liquid mixing tank on the initial turning of the pressure relief bung and be fully open in about one full turn of the bung so as to relieve the pressure in the tank in less time than the minimum times required to remove the liquid mixer and manhole cover and the bung itself. Thus, when a person just cracks open the pressure relief bung and then advances it to just one full turn and that person or possibly someone else immediately proceeds to disconnect either the liquid mixer or the manhole cover or another but solid bung, whichever is then in place, any gaseous pressure in the tank is fully relieved before the pressure relief bung itself and either the liquid mixer or manhole cover or another but solid bung can possibly be free of connection to the tank.

Preferably, the vent holes are related to the pitch of the threads so that only about one-quarter turn of the pressure relief bung is required to start their opening and they are wide open at no more than one full turn to quickly fully relieve any gaseous pressure in the liquid mixing tank. Furthermore, the pressure relief bung is preferably provided with an integral second hollow cylindrical section concentric with and located inwardly of the above mentioned hollow cylindrical section. The second hollow cylindrical section is formed with a central cavity that is closed at one end to the interior of the liquid mixing tank and is open at an opposite end external of the liquid mixing tank and has multiple flat sides or flats to receive a tool such as a hex key to turn the pressure relief bung. Moreover, in the preferred embodiment, the head is also formed with multiple flat sides or flats so as to be adapted to be engaged by a tool such as a wrench to further facilitate operation of the pressure relief bung.

It is therefore an object of the present invention to provide a new and improved manner of venting a liquid mixing tank.

Another object is to provide a pressure relief bung of wide application in venting large portable liquid tanks.

Another object is to provide a pressure relief bung that operates with slight turning to provide ample pressure relief of a large portable liquid tank.

Another object is to provide a quick acting pressure relief bung for large portable liquid tanks that is adapted to fit a bung flange on the tank and also a bung flange on various detachable covers that close and seal a large opening in the top of the tank.

Another object is to provide a quick acting pressure relief bung having a vent hole arrangement that is fully open to quickly vent a large portable liquid tank past a seal on the bung on only one turn of the bung and in less time than the minimum required to fully disengage the bung or disconnect a manhole cover covering a large opening on the tank.

Another object is to provide a liquid mixing tank and associated manhole cover and liquid mixer each with the option of a pressure relief bung that is operable in one turn to fully vent any gaseous pressure in the tank in less than the minimum time required to free either the manhole cover, liquid mixer or the pressure relief bung itself or another but solid bung in the tank.

Another object is to provide a liquid mixing tank with a pressure relief bung having a seal and a vent hole arrangement that is operable in one turn of the bung to fully vent any gaseous pressure in the tank past the seal in less than the minimum time required to disconnect either a liquid mixer or manhole cover therefrom or to disconnect the pressure relief bung itself or another but solid bung.

These and other objects and advantages of the present invention will become more apparent from the following description of the preferred embodiment wherein:

DETAILED DESCRIPTION OF THE INVENTION

Figure 1:
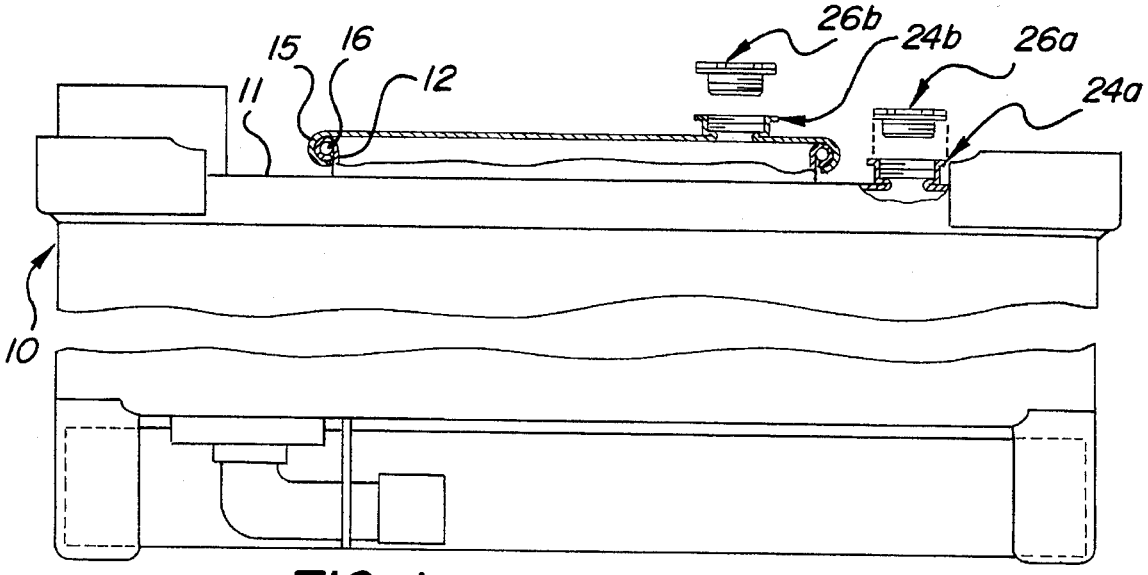
FIG. 1 is a side view with parts in section of a liquid mixing tank having a storage cover mounted thereon and includes an exploded view of a pressure relief bung according to the invention for installing in the manhole cover and an identical pressure relief bung for installing in the top of the tank.
Figure 2:
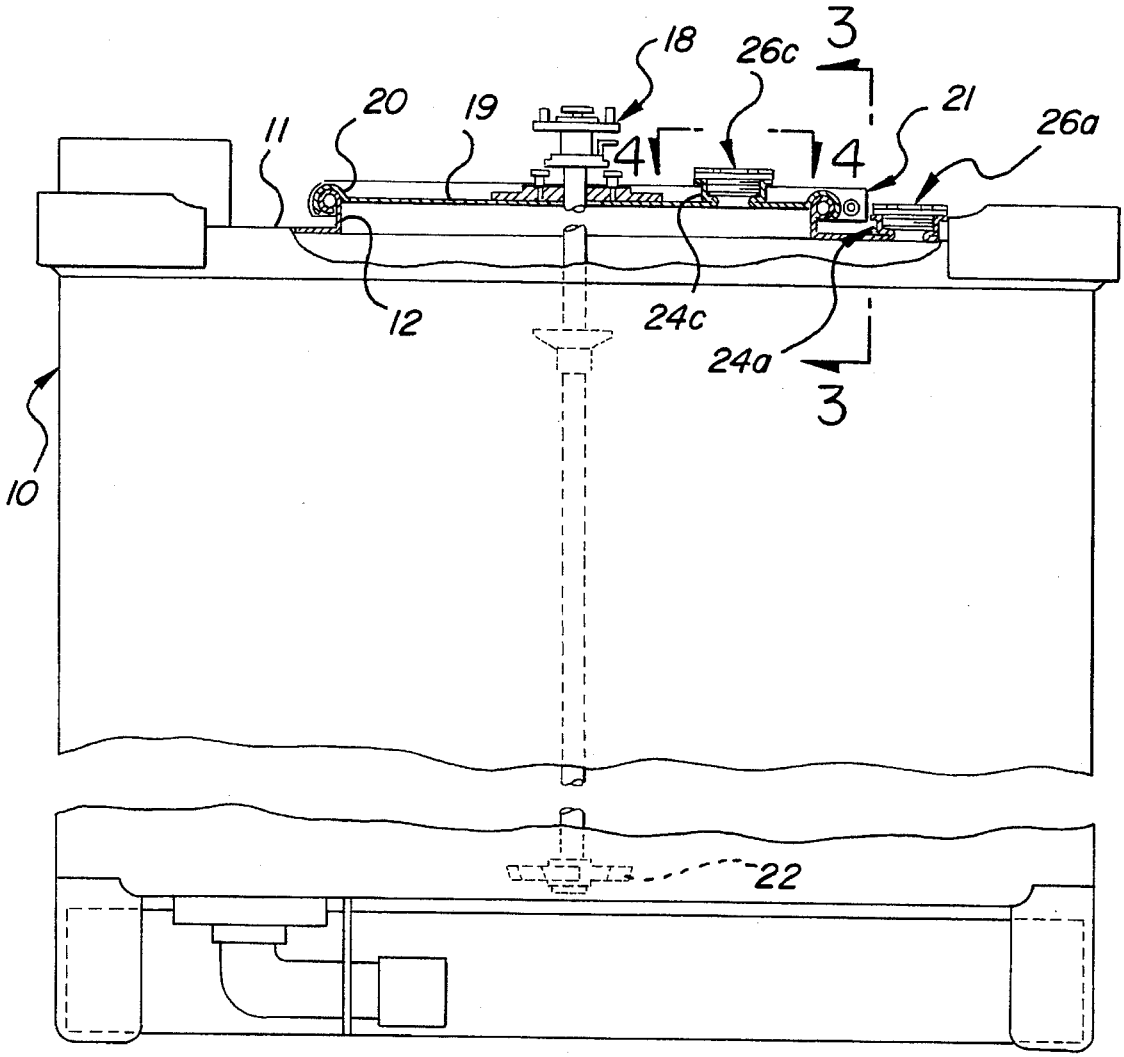
FIG. 2 is a another side view of the tank in FIG. 1 but with a liquid mixer mounted thereon in place of the storage cover.
Figure 3:
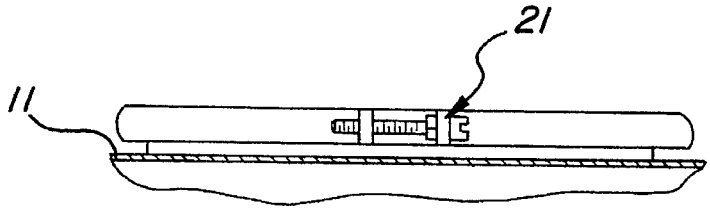
FIG. 3 is a view taken along the line 2—2 in FIG. 1 when looking in the direction of the arrows.
Figure 4:
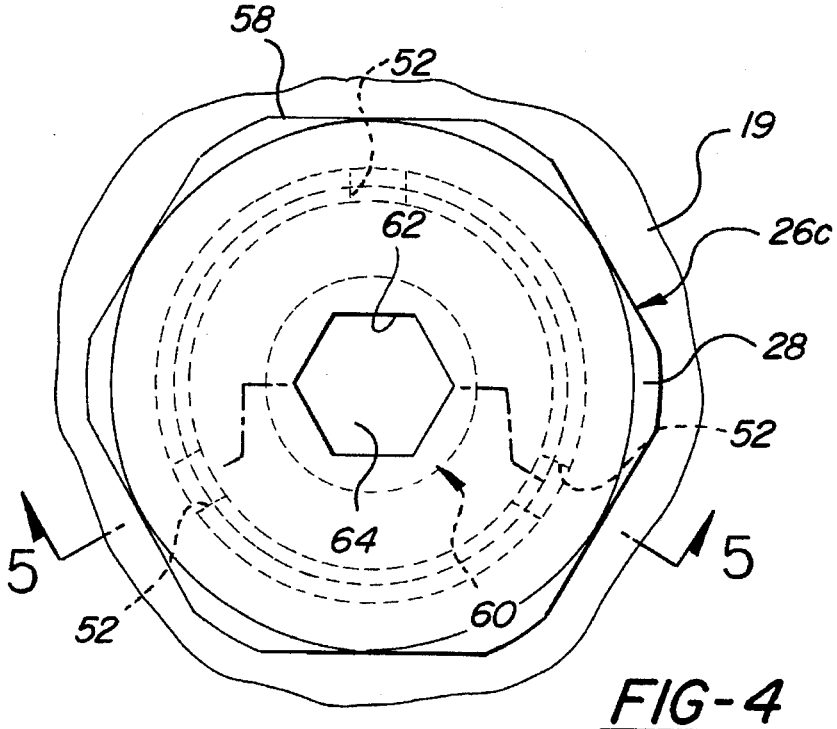
FIG. 4 is an enlarged top view of one of the pressure relief bungs taken along the line 4—4 in FIG. 2 when looking in the direction of the arrows.

There is illustrated in FIG. 1 a large portable mixing tank 10 for automotive paint and solvents having a top wall 11 with a large access opening 12. In the particular embodiment illustrated, the tank has a capacity of 575 gallons and the opening 12 is round and has a diameter of about 22 inches. A manhole cover 14 has a peripheral lip 15 that snap fits over a raised and rounded flange 16 on the top wall extending about the opening 12 to sealingly close the latter for paint or solvent storage and transit and also when the tank is empty or only partially full. As illustrated in FIGS. 2 and 3, the paint contained in the tank is mixed at site of usage by removing the manhole cover 14 and installing in its place a liquid mixer mounting cover 18 supporting a liquid mixer 19. The mounting cover 18 has a rounded flange 20 that fits on the tank flange 16 and is secured in place with a clamp assembly 21 to sealingly close the opening 12 and firmly support the mixer on the tank. The mixer 19 extends down into the tank and has a paddle wheel 22 at its lower end and is adapted at its upper end to be driven by a portable drive unit (not shown) of the type disclosed in applicant's U.S. Pat. Nos. 5,102,151 and 5,203,574 which are hereby incorporated by reference. Both the storage cover 14 and the mixer 19 can be quickly removed from the tank by a person at which time the cover and mixer are free of the tank and could be propelled or blown off the tank by air pressure trapped therein. There is a certain minimum time required to release the manhole cover and mixer and the latter can take longer because of the clamp assembly 21.

According to the present invention, identical bung flanges 24A, 24B and 24C are provided on the tank top wall 11, manhole cover 14 and liquid mixer mounting cover 19, respectively, and identical pressure relief bungs 26A, 26B and 26C are provided that fit the respective bung flanges. The description that follows is directed to the pressure relief bung 26C and its bung flange 24C on the liquid mixing mounting cover 19 and it will be understood that the description equally applies to the other bung flanges 24A, 24B and pressure relief bungs 26A, 26B and that they are all interchangeable, respectively. It will also be understood that while the bung flanges are shown as being formed integral with the tank's top wall, the manhole cover and the mixer mounting cover, anyone or all of these bung flanges could be separate parts that are sealingly fixed in place such as by welding.

Referring to FIGS. 4–7, the pressure relief bung 26C comprises a head 28 and an integral hollow cylindrical section 32 having a closed end 34 at the head 28 and an open end 36. A right-hand male thread 38 on the exterior of the hollow cylindrical section 32 extends from its open end 36 towards the head 28 and is adapted to engage a right-hand internal thread 40 in the bung flange 24C and close off the opening therethrough. In the particular embodiment illustrated, the thread on the pressure relief bung and bung flange is a 2"–11 ½ N.P.T straight thread that is commonly used on this and smaller as well as larger size tanks and other similar size liquid containers.

Figure 5:
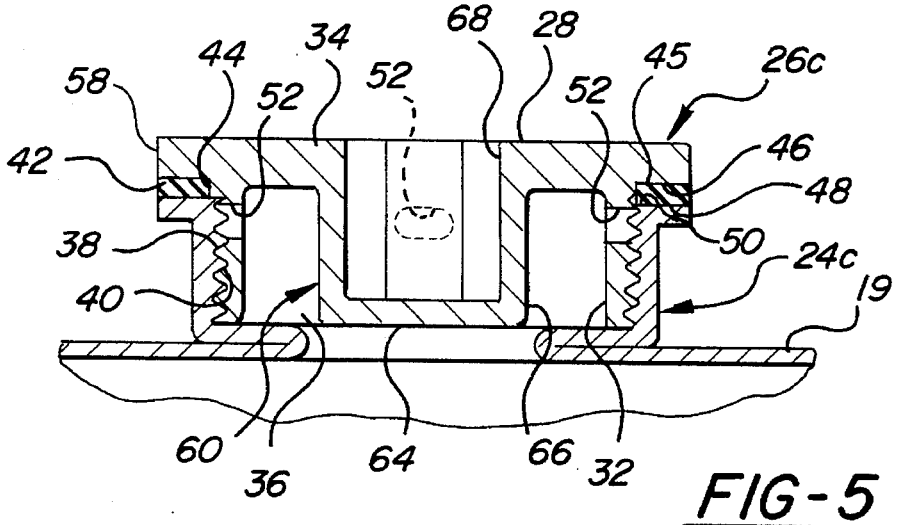
FIG. 5 is a view of taken along the line 5—5 in FIG. 4 when looking in the direction of the arrows.

As illustrated in FIG. 5, a flat sided rubber sealing ring 42 of rectangular cross section is received on the hollow cylindrical bung section 32 at an unthreaded annular land portion 44 adjacent its external or male thread 38. The sealing ring 42 is thus positioned on tightening of the bung 26C in the bung flange 24C to have one flat side 45 seal against an annular radial flat 46 on the backside of the head 28 and to have an opposite flat side 48 seal against a similar annular radial flat 50 on the bung flange 26C outward of its threaded hole.

Venting of the tank by the pressure relief bung with either the manhole cover or liquid mixer sealingly secured in place is provided by a plurality of angularly spaced, elongated vent holes 52 in the externally threaded cylindrical bung portion 38. It is desired for manufacturing purposes that the number of holes be kept to a minimum and in the preferred embodiment illustrated, there are three of the elongated vent holes 52 which together with their location and relative dimensions later described was found sufficient for all intended purposes. The elongated vent holes 52 are located in a common radial plane immediately adjacent the sealing ring side 48 that is adapted to contact the sealing surface 50 of the bung flange. The elongated vent holes 52 are thus in a position to communicate the interior of the tank with atmosphere through the open end 36 of the hollow cylindrical bung portion 38 and past the nearest sealing ring side 48 on initial counter-clockwise turning of the bung 26C to disengage from its closed and sealed relationship with the bung flange 24C illustrated in FIG. 5.

The elongated vent holes 52 have a cross-section that is elongated perpendicular to the bung axis and together present a total vent area that is large enough to start quickly relieving any air pressure in the tank on initial partial turning of the bung then with one full turn at a rate that assures full pressure relief in the shortest of the minimum times required to disconnect the storage cover and, alternatively, the liquid mixer from the tank. As mentioned earlier, the storage cover can require less time to disconnect than the mixer and furthermore it is more likely to be propelled by trapped air pressure because of its lighter weight. In that case, the objective is to ensure that the vent area be keyed to the minimum time required to release the storage cover as will now described.

Figure 6:
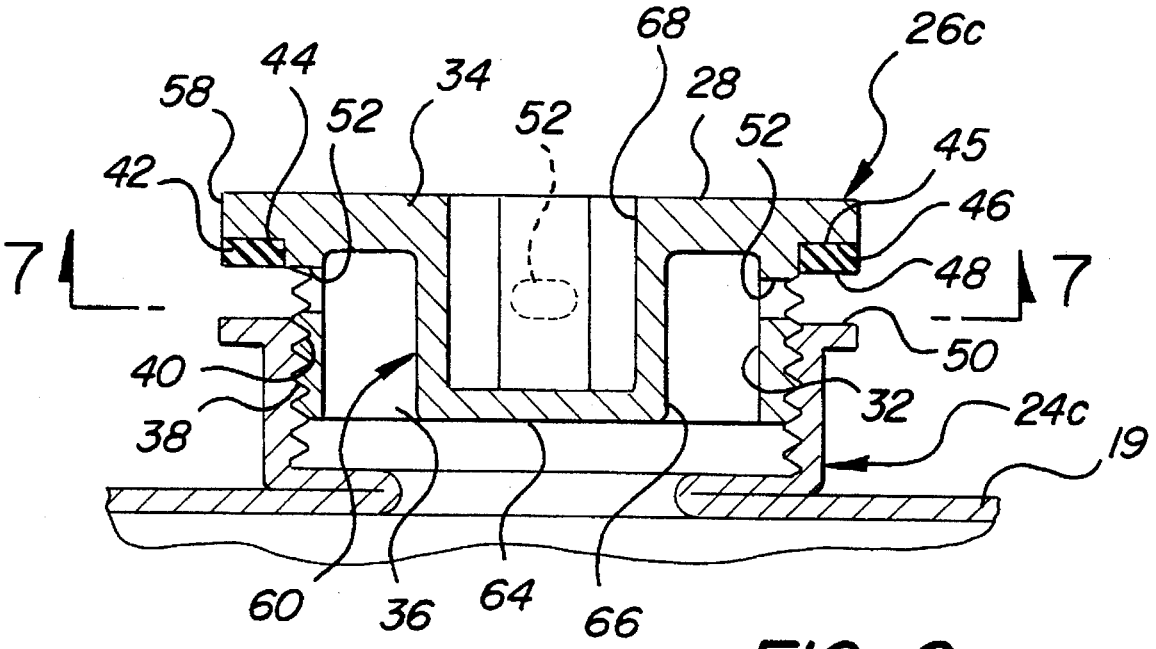
FIG. 6 is a view similar to FIG. 5 but showing the pressure relief bung opened one full turn.
Figure 7:
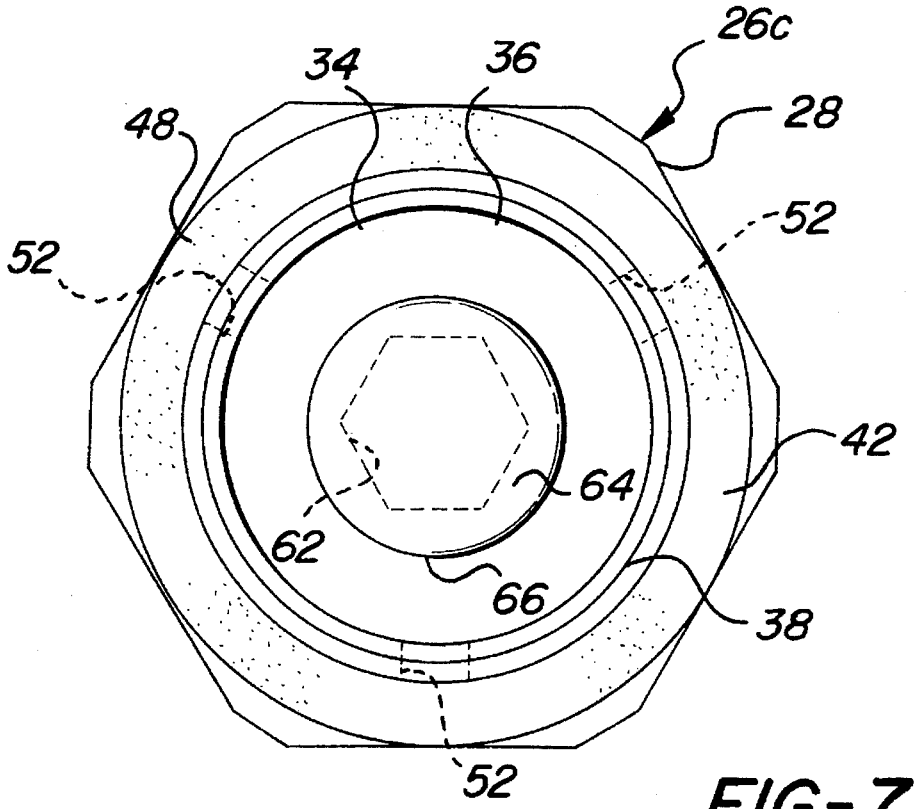
FIG. 7 is a view taken along the line 7—7 in FIG. 6.

To ensure that the tank is fully relieved of any trapped air pressure prior to removal of the storage cover, it was found that this should start occurring with only partial turning of the bung and preferably in about one-quarter turn of the bung and that the vents should be fully open at about one full turn of the bung as illustrated in FIG. 6. It was found that a quarter-turn is a common amount of initial turning by a person unscrewing the bung prior to any attempt to release the storage cover which the person may be inclined to do knowing that pressure relief has been started. This is accomplished in the illustrated embodiment by the elongated vent holes having an elongated cross-section with a width transverse of the male thread about one and one-half times the thread width and a length lateral of the male thread about three times the thread width such that the vent holes are fully open along their entire length and width with one full turn of the bung.

In the field, the tanks are serviced by a wide range of people and they may have only a limited variety of tools readily at hand to turn the bung. The bung is adapted to be turned with at least two different types of tools; namely, a crescent or open end or socket end type wrench and a key type tool or wrench. Use of the former type of wrenches to turn the bung is provided by forming the bung head 28 with a hexagonal side 58 as illustrated but it will be understood that other multisided external configurations could be utilized.

Advantageous direction of the trapped air to the vent holes 52 as well as use of a key type tool to turn the bung is provided by an integral second hollow cylindrical section 60 concentric with and located inwardly of the hollow cylindrical section 38. The hollow cylindrical section 60 extends the length of the other hollow cylindrical section 38 and has a central hexagonal sided interior or cavity 62 that is closed at one end 64 to the interior of the tank. The closed end 64 together with the outer side 66 of the hollow cylindrical section 60 and the opposed inner side 68 of the other hollow cylindrical section 38 forms a direct path from the interior of the tank to the vent holes 52 to help effect rapid venting. The hollow cylindrical section 60 is open at an opposite end 68 external of the tank to receive a hex key tool. However, it will also be understood that other multisided internal configurations could be utilized for different configuration keys.

The invention has been described in an illustrative manner with respect to the presently preferred embodiment, and it is to be understood that the terminology that has been used is intended to be in the nature of words of description rather than of limitation. Obviously, many modifications and variations of the present invention in light of the above teachings may be made. For example, the universal pressure relief plug of the present invention may optionally be used for availability, convenience and/or economic reasons at only one or two of the three bung flanges illustrated and a solid more readily available and possibly lower cost conventional type of solid bung of the same size used at the remaining bung flanges. It is therefore to be understood that within the scope of the appended claims, the invention may be practiced otherwise than as specifically shown and described.

What is claimed is:

1. In combination, a portable liquid mixing tank having a top wall with an opening therein, a manhole cover adapted to readily releasably connect to said tank and sealingly close said opening and requiring a certain minimum amount of time to be disconnected from said tank, a liquid mixer mounting cover adapted to readily releasably connect to said tank and sealingly close said opening and requiring a certain minimum amount of time to be disconnected from said tank, wherein air trapped in said tank while either said manhole cover or said mounting cover is in place increases in pressure with increasing ambient temperature and has the capacity to blow off said manhole cover and said mounting cover when they are freed from said tank, a bung flange with an internal threaded hole therethrough on said top wall and said manhole cover and said mounting cover respectively, all of said internal threaded holes in said bung flanges being similar, a bung screwed in each said bung flange and adapted to fit the other bung flanges, at least one of said bungs being a pressure relief bung having an integral head and hollow cylindrical section, said hollow cylindrical section having a closed end at said head and an open end and a male thread extending from said open distal end toward said head, said male thread adapted to individually engage the internal threaded hole of all of said bung flanges and close same, a sealing ring received on said hollow cylindrical section adjacent said male thread, said sealing ring having one side adapted to seal against said head and an opposite side adapted to seal against all of said bung flanges, said hollow cylindrical section having a plurality of elongated vent holes in a common plane spaced a distance from said head and adapted to communicate the interior of said tank with atmosphere through said open end of said hollow cylindrical section on initial turning of said pressure relief bung to disengage from the respective said bung flanges from a closed and sealed relationship therewith, said elongated vent holes having a cross-section elongated along said plane and collectively providing a total vent area that starts opening on partial turning of said pressure relief bung and is fully open at about one full turn of said pressure relief bung, and said sealing ring having a thickness narrower than said distance between said vent holes and said head to require additional turning of said pressure relief bung after release of the seal from said sealing ring before venting of the tank through the vent holes will occur.

2. A combination as set forth in claim 1, wherein said elongated vent holes have an elongated cross-section with a width transverse of said male thread about one and one-half times that of said male thread and a length lateral of said male thread about three times said width.

3. A combination as set forth in claim 1, wherein about only one quarter turn of said pressure relief bung is required to start relieving any air pressure in said tank.

4. A combination as set forth in claim 1, wherein said bung has an integral second hollow cylindrical section concentric with and located inwardly of said first mentioned hollow cylindrical section and adapted to co-operate therewith to guide air in said tank directly to said elongated vent holes, said second hollow cylindrical section having a central multisided interior that is closed at one end to the interior of said liquid mixing tank and that is open at an opposite end external of said liquid mixing tank to receive a tool for turning said pressure relief bung.

5. A combination as set forth in claim 4 wherein said head has a multisided exterior adapted to be engaged by a different tool to turn said pressure relief bung.

6. A combination set forth in claim 5 wherein said central multisided interior is hexagonal.

7. A pressure relief bung for a container comprising:

a head;

a hollow cylindrical section integral with said head;

said hollow cylindrical section including an open distal end and a closed end contiguous said head;

said hollow cylindrical section including an outer surface with a threaded section thereon extending from said open distal end toward said head and adapted to engage a mating threaded surface in an opening of the container;

said hollow cylindrical section having at least one vent hole spaced a distance from said head and adapted to permit the container to communicate with atmosphere through said open end of said hollow cylindrical section and through said vent hole;

a sealing ring disposed on said outer surface of said hollow cylindrical section between said vent hole and said head;

said sealing ring having a first side adapted to seal against said head and a second side adapted to seal against a sealing surface of the container; and said sealing ring having a thickness narrower than said distance between said vent hole and said head whereby the seal between said sealing ring and the sealing surface of the container can be broken after an initial turn of said bung without simultaneous release of pressure from the container through said vent hole.

8. A pressure relief bung as set forth in claim 7 wherein said head includes an integral second hollow cylindrical section perpendicular to said vent hole and having a multi-sided interior that is closed at one end and open at an opposite end to receive a tool for turning said pressure relief bung.

* * * * *